US012331752B2

(12) United States Patent
Andou et al.

(10) Patent No.: US 12,331,752 B2
(45) Date of Patent: Jun. 17, 2025

(54) BLOWER AND HEAT PUMP UNIT

(71) Applicant: DAIKIN INDUSTRIES, LTD., Osaka (JP)

(72) Inventors: Hiroki Andou, Osaka (JP); Takashi Ono, Osaka (JP); Toshihiro Mori, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 352 days.

(21) Appl. No.: 17/677,819

(22) Filed: Feb. 22, 2022

(65) Prior Publication Data

US 2022/0178382 A1 Jun. 9, 2022

Related U.S. Application Data

(63) Continuation of application No. PCT/JP2020/031499, filed on Aug. 20, 2020.

(30) Foreign Application Priority Data

Aug. 26, 2019 (JP) ..... 2019-153797

(51) Int. Cl.
*F04D 29/38* (2006.01)
*F04D 29/54* (2006.01)
*F04D 29/66* (2006.01)

(52) U.S. Cl.
CPC ..... *F04D 29/38* (2013.01); *F04D 29/54* (2013.01); *F04D 29/66* (2013.01)

(58) Field of Classification Search
CPC ..... F24F 1/0029; F24F 1/38; F04D 29/54
See application file for complete search history.

(56) References Cited

U.S. PATENT DOCUMENTS 4,253,800 A * 3/1981 Segawa ..... F04D 29/662 416/500
5,520,513 A * 5/1996 Kuroki ..... F01P 5/06 416/169 A (Continued)

FOREIGN PATENT DOCUMENTS

CN 1073241 A * 6/1993 ..... F04D 29/4213
CN 1362775 A * 8/2002 ..... H02K 9/10

(Continued)

OTHER PUBLICATIONS

International Preliminary Report of corresponding PCT Application No. PCT/JP2020/031499 dated Mar. 10, 2022.

(Continued)

*Primary Examiner* — Nelson J Nieves
(74) *Attorney, Agent, or Firm* — Global IP Counselors, LLP

(57) ABSTRACT

A blower includes a propeller fan, and an enclosure. The propeller fan is configured to rotate around a rotation axis. The propeller fan includes a plurality of blades at unequal pitches. The enclosure houses the propeller fan. The enclosure includes a bell mouth. The enclosure has a depth L. The bell mouth includes a cylindrical part parallel to the rotation axis.

$$0.14 \leq \frac{H2}{H0} \leq 0.22\#$$

A length of the blades is H0 in a rotation axis direction, and a length of the cylindrical part is H2 in the rotation axis direction.

12 Claims, 15 Drawing Sheets

(56) References Cited

U.S. PATENT DOCUMENTS

| | | | | |
|---|---|---|---|---|
| 6,499,948 | B1 * | 12/2002 | Iyer | F04D 29/545 416/189 |
| 8,616,844 | B2 * | 12/2013 | Farlow | F04D 29/526 416/189 |
| 2004/0258530 | A1 * | 12/2004 | Oono | F04D 29/384 416/223 R |
| 2006/0034686 | A1 * | 2/2006 | Smiley, III | F04D 29/4213 415/204 |
| 2011/0127019 | A1 * | 6/2011 | Abastari | F24F 1/38 415/219.1 |
| 2012/0018117 | A1 * | 1/2012 | Yamada | F24F 1/0063 165/104.34 |
| 2013/0125579 | A1 * | 5/2013 | Okazawa | F24F 1/38 415/220 |
| 2015/0240645 | A1 | 8/2015 | Yokose et al. | |
| 2016/0003487 | A1 * | 1/2016 | Iwase | F04D 29/384 415/121.2 |
| 2016/0348699 | A1 | 12/2016 | Arai et al. | |
| 2018/0224135 | A1 * | 8/2018 | Yamamoto | F24F 1/38 |
| 2018/0363928 | A1 * | 12/2018 | Yamamoto | F24F 1/40 |
| 2019/0010960 | A1 * | 1/2019 | Nakashima | F04D 29/547 |
| 2019/0137120 | A1 | 5/2019 | Yamamoto et al. | |
| 2019/0316790 | A1 * | 10/2019 | Goto | F24F 1/50 |
| 2020/0116159 | A1 * | 4/2020 | Yang | F04D 29/328 |
| 2020/0158373 | A1 * | 5/2020 | Yang | F24F 11/88 |
| 2020/0408225 | A1 * | 12/2020 | Arai | F04D 19/002 |
| 2021/0164666 | A1 * | 6/2021 | Lockwood | F24F 1/0011 |

FOREIGN PATENT DOCUMENTS

| | | | | | |
|---|---|---|---|---|---|
| CN | 1415905 | A | * | 5/2003 | F24F 1/38 |
| CN | 107023509 | A | * | 8/2017 | F04D 25/08 |
| EP | 1357296 | A1 | * | 10/2003 | F04D 29/384 |
| EP | 3 623 638 | A1 | | 3/2020 | |
| JP | H04350399 | A | * | 12/1992 | |
| JP | 5-223093 | A | | 8/1993 | |
| JP | 2003-120589 | A | | 4/2003 | |
| JP | 2003184797 | A | * | 7/2003 | |
| JP | 4140236 | B2 | | 6/2008 | |
| JP | 2012136941 | A | * | 7/2012 | |
| JP | 6379062 | B2 | * | 8/2018 | |
| JP | 2019-2378 | A | | 1/2019 | |
| KR | 880000521 | B1 | * | 4/1988 | |
| WO | WO-2012035577 | A1 | * | 3/2012 | F04D 29/522 |
| WO | 2015/121989 | A1 | | 8/2015 | |
| WO | 2017060973 | A1 | | 4/2017 | |
| WO | 2018016012 | A1 | | 1/2018 | |

OTHER PUBLICATIONS

European Search Report of corresponding EP Application No. 20 85 7322.0 dated Sep. 20, 2022.

International Search Report of corresponding PCT Application No. PCT/JP2020/031499 dated Sep. 29, 2020.

* cited by examiner

BLOWER AND HEAT PUMP UNIT

CROSS-REFERENCE TO RELATED APPLICATIONS

This is a continuation of international Application No. PCT/JP2020/031499 filed on Aug. 20, 2020, which claims priority to Japanese Patent Application No. 2019-153797, filed on Aug. 26, 2019. The entire disclosures of these applications are incorporated by reference herein.

BACKGROUND

Field of Invention

The present disclosure relates to a blower to be used in an air conditioner and a heat pump unit used in an air conditioner.

Background Information

Japanese Patent No. 4140236 discloses a blower to be included in an outdoor unit of an air conditioning device.

SUMMARY

Noise emitted by a blower needs to be suppressed. The noise includes noise from normal operating sound and noise at a specific frequency. To suppress the noise at a specific frequency, a fan at unequal pitches may be used in the blower. However, optimized design to reduce both the noise from normal operating sound and the noise at a specific frequency has not been given much consideration in the past.

A blower of one aspect includes a propeller fan and an enclosure. The propeller fan rotates around a rotation axis and includes a plurality of blades at unequal pitches. The enclosure houses the propeller fan, includes a bell mouth, and has a depth L. The bell mouth includes a cylindrical part parallel to the rotation axis.

$$0.14 \leq \frac{H2}{H0} \leq 0.22\#$$

A length of the blade in a rotation axis direction is H0 and a length of the cylindrical part in the rotation axis direction is H2. This configuration can suppress noise.

The blower of another aspect includes a propeller fan and an enclosure. The propeller fan rotates around a rotation axis and includes a plurality of blades at unequal pitches. The enclosure houses the propeller fan, includes a bell mouth, and has a depth L. The bell mouth includes a cylindrical part parallel to the rotation axis.

$$0.045 \leq \frac{H2}{\phi} \leq 0.070\#$$

A diameter of the propeller fan is φ and a length of the cylindrical part in a rotation axis direction is H2. This configuration can suppress noise.

DETAILED DESCRIPTION OF EMBODIMENT(S)

Embodiment

(1) Overall Configuration

Figure 1:
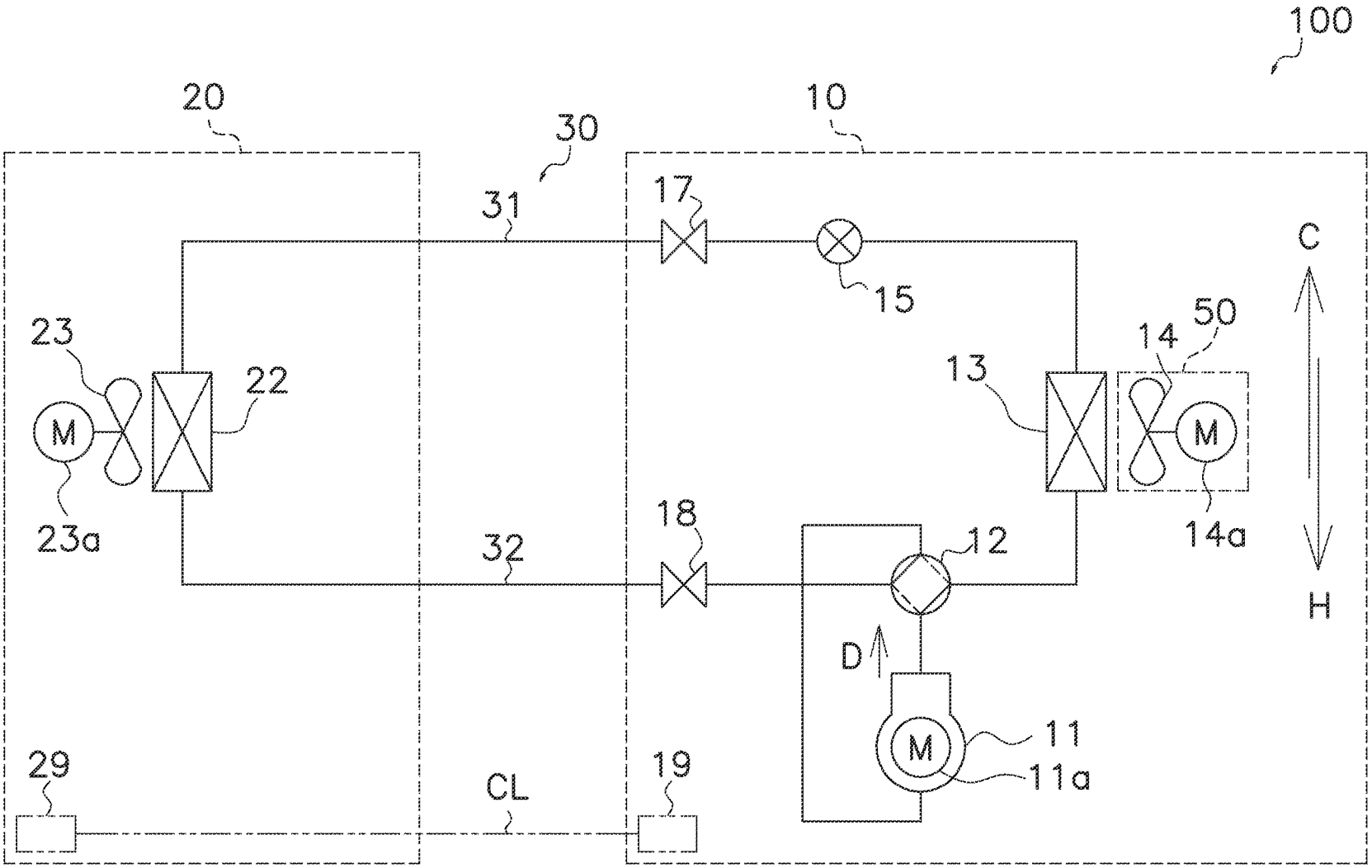
FIG. 1 is a circuit diagram of a heat pump device 100.

FIG. 1 is a circuit diagram of a heat pump device 100 configured as an air conditioner. The heat pump device 100 includes a heat source unit 10, a utilization unit 20, and a connection piping 30. As will be described later, the heat source unit 10 includes a blower 50.

(2) Detailed Configuration

(2-1) Heat Source Unit 10

The heat source unit 10 is a heat pump unit that functions as a heat source. The heat source unit 10 includes a compressor 11, a four-way switching valve 12, a heat source heat exchanger 13, a blower 50, an expansion valve 15, a liquid shutoff valve 17, a gas shutoff valve 18, and a heat source control unit 19.

(2-1-1) Compressor 11

The compressor 11 sucks and compresses a low-pressure gas refrigerant to generate a high-pressure gas refrigerant. The compressor 11 includes a compressor motor 11*a*. The compressor motor 11*a* generates power necessary for compression.

(2-1-2) Four-Way Switching Valve 12

The four-way switching valve 12 switches connection of internal pipes. When the heat pump device 100 executes a cooling operation, the four-way switching valve 12 implements connection shown by solid lines of FIG. 1. When the heat pump device 100 executes a heating operation, the four-way switching valve 12 implements connection shown by broken lines of FIG. 1.

(2-1-3) Heat Source Heat Exchanger 13

The heat source heat exchanger 13 exchanges heat between the refrigerant and air. In the cooling operation, the heat source heat exchanger 13 fiinctions as a heat radiator (or condenser). In the heating operation, the heat source heat exchanger 13 functions as a heat absorber (or evaporator).

(2-1-4) Blower 50

The blower 50 promotes heat exchange by the heat source heat exchanger 13. The heat source heat exchanger 13 exchanges heat between air in an air flow formed by the blower 50, and the refrigerant. The blower 50 includes a propeller fan 14 and a propeller fan motor 14*a*. The propeller fan motor 14*a* generates power necessary for moving the propeller fan 14. The structure of the blower 50 will be described later.

(2-1-5) Expansion Valve 15

The expansion valve 15 is a valve with adjustable opening degree. The expansion valve 15 decompresses the refrigerant. Furthermore, the expansion valve 15 controls a flow rate of the refrigerant.

(2-1-6) Liquid Shutoff Valve 17

The liquid shutoff valve 17 can shut off a refrigerant flow path. The liquid shutoff valve 17 is closed, for example, by an installation worker during installation of the heat pump device 100 or the like.

(2-1-7) Gas Shutoff Valve 18

The gas shutoff valve 18 can shut off the refrigerant flow path. The gas shutoff valve 18 is closed, for example, by an installation worker during installation of the heat pump device 100 or the like.

(2-1-8) Heat Source Control Unit 19

The heat source control unit 19 includes a microcomputer and a memory. The heat source control unit 19 controls the compressor motor 11*a*, the four-way switching valve 12, the propeller fan motor 14*a*, the expansion valve 15, and the like. The memory stores software for controlling these parts.

(2-2) Utilization Unit 20

The utilization unit 20 provides a user with low-temperature heat or high-temperature heat. The utilization unit 20 includes a utilization heat exchanger 22, a utilization fan 23, and a utilization control unit 29.

(2-2-1) Utilization Heat Exchanger 22

The utilization heat exchanger 22 exchanges heat between the refrigerant and air. In the cooling operation, the utilization heat exchanger 22 functions as a heat absorber (or evaporator). In the heating operation, the utilization heat exchanger 22 functions as a heat radiator (or condenser).

(2-2-2) Utilization Fan 23

The utilization fan 23 promotes heat exchange by the utilization heat exchanger 22. The utilization fan 23 includes a utilization fan motor 23*a*. The utilization fan motor 23*a* generates power necessary for moving air.

(2-2-3) Utilization Control Unit 29

The utilization control unit 29 includes a microcomputer and a memory. The utilization control unit 29 controls the utilization fan motor 23*a* and the like. The memory stores software for controlling these parts.

The utilization control unit 29 transmits and receives data and commands to and from the heat source control unit 19 via a communication line CL.

(2-3) Connection Piping 30

The connection piping 30 guides the refrigerant moving between the heat source unit 10 and the utilization unit 20. The connection piping 30 includes a liquid connection pipe 31 and a gas connection pipe 32.

(2-3-1) Liquid Connection Pipe 31

The liquid connection pipe 31 mainly guides a liquid refrigerant or a gas-liquid two-phase refrigerant. The liquid connection pipe 31 connects the liquid shutoff valve 17 to the utilization unit 20.

(2-3-2) Gas Connection Pipe 32

The gas connection pipe 32 mainly guides a gas refrigerant. The gas connection pipe 32 connects the gas shutoff valve 18 to the utilization unit 20.

(3) Overall Operation

The following description assumes that the refrigerant changes in connection with phase transition such as condensation or evaporation in the heat source heat exchanger 13 and the utilization heat exchanger 22. However, alternatively, the refrigerant may not necessarily experience phase transition in the heat source heat exchanger 13 and the utilization heat. exchanger 22.

(3-1) Cooling Operation

In the cooling operation, the refrigerant circulates in a direction indicated by arrow C in FIG. The compressor 11 discharges the high-pressure gas refrigerant in a direction indicated by arrow D in FIG. 1. After that, the high-pressure gas refrigerant reaches the heat source heat exchanger 13 via the four-way switching valve 12. In the heat source heat exchanger 13, the high-pressure gas refrigerant condenses to change into a high-pressure liquid refrigerant. After that, the high-pressure liquid refrigerant reaches the expansion valve 15. In the expansion valve 15, the high-pressure liquid refrigerant is decompressed to change into a low-pressure gas-liquid two-phase refrigerant. After that, the low-pressure gas-liquid two-phase refrigerant passes through the liquid shutoff valve 17 and the liquid connection pipe 31 to reach the utilization heat exchanger 22. In the utilization heat exchanger 22, the low-pressure gas-liquid two-phase refrigerant evaporates to change into a low-pressure gas refrigerant. In this process, air in the room where the user stays decreases in temperature. After that, the low-pressure gas refrigerant reaches the compressor 11 via the gas connection pipe 32, the gas shutoff valve 18, and the four-way switching valve 12. After that, the compressor 11 takes in the low-pressure gas refrigerant.

(3-2) Heating Operation

In the heating operation, the refrigerant circulates in a direction indicated by arrow H in FIG. 1. The compressor 11 discharges the high-pressure gas refrigerant in a direction indicated by arrow D in FIG. 1. After that, the high-pressure gas refrigerant reaches the utilization heat exchanger 22 via the four-way switching valve 12, the gas shutoff valve 18, and the gas connection pipe 32. In the utilization heat exchanger 22, the high-pressure gas refrigerant condenses to change into a high-pressure liquid refrigerant. In this process, air in the room where the user stays increases in temperature. After that, the high-pressure liquid refrigerant reaches the expansion valve 15 via the liquid connection pipe 31 and the liquid shutoff valve 17. In the expansion valve 15, the high-pressure liquid refrigerant is decompressed to change into a low-pressure gas-liquid two-phase refrigerant. After that, the low-pressure gas-liquid two-phase refrigerant reaches the heat source heat exchanger 13. In the heat source heat exchanger 13, the low-pressure gas-liquid two-phase refrigerant evaporates to change into a low-pressure gas refrigerant. After that, the low-pressure gas refrigerant reaches the compressor 11 via the four-way switching valve 12. After that, the compressor 11 takes in the low-pressure gas refrigerant.

(4) Configuration of Blower 50

Figure 2:
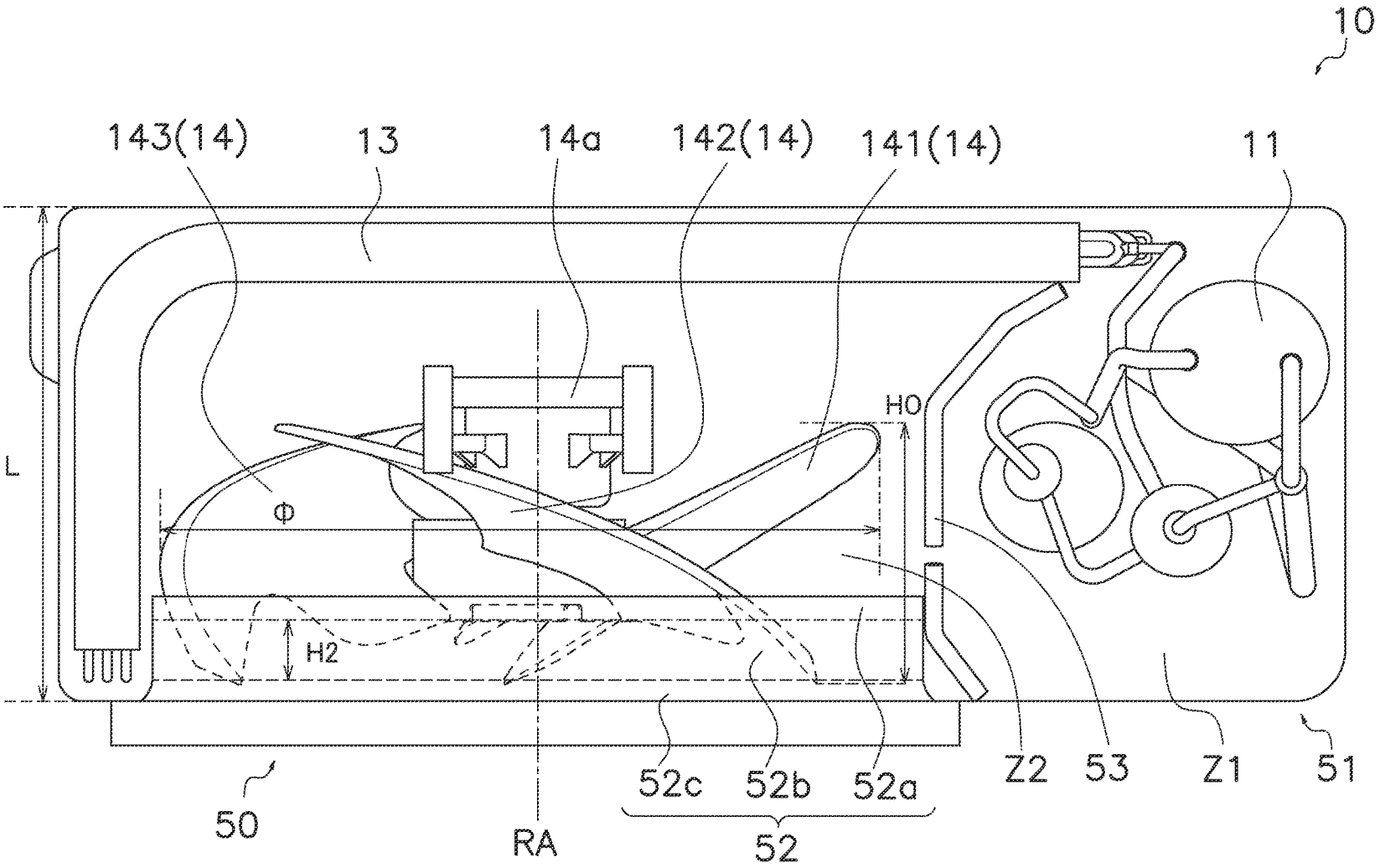
FIG. 2 is a plan view of the interior of a heat source unit 10.

FIG. 2 is a plan view of the interior of the heat source unit 10. The heat source unit 10 is equipped with the blower 50.

The blower 50 includes a propeller fan 14 a propeller fan motor 14*a*, and an enclosure 51.

(4-1) Propeller Fan 14

Figure 3:
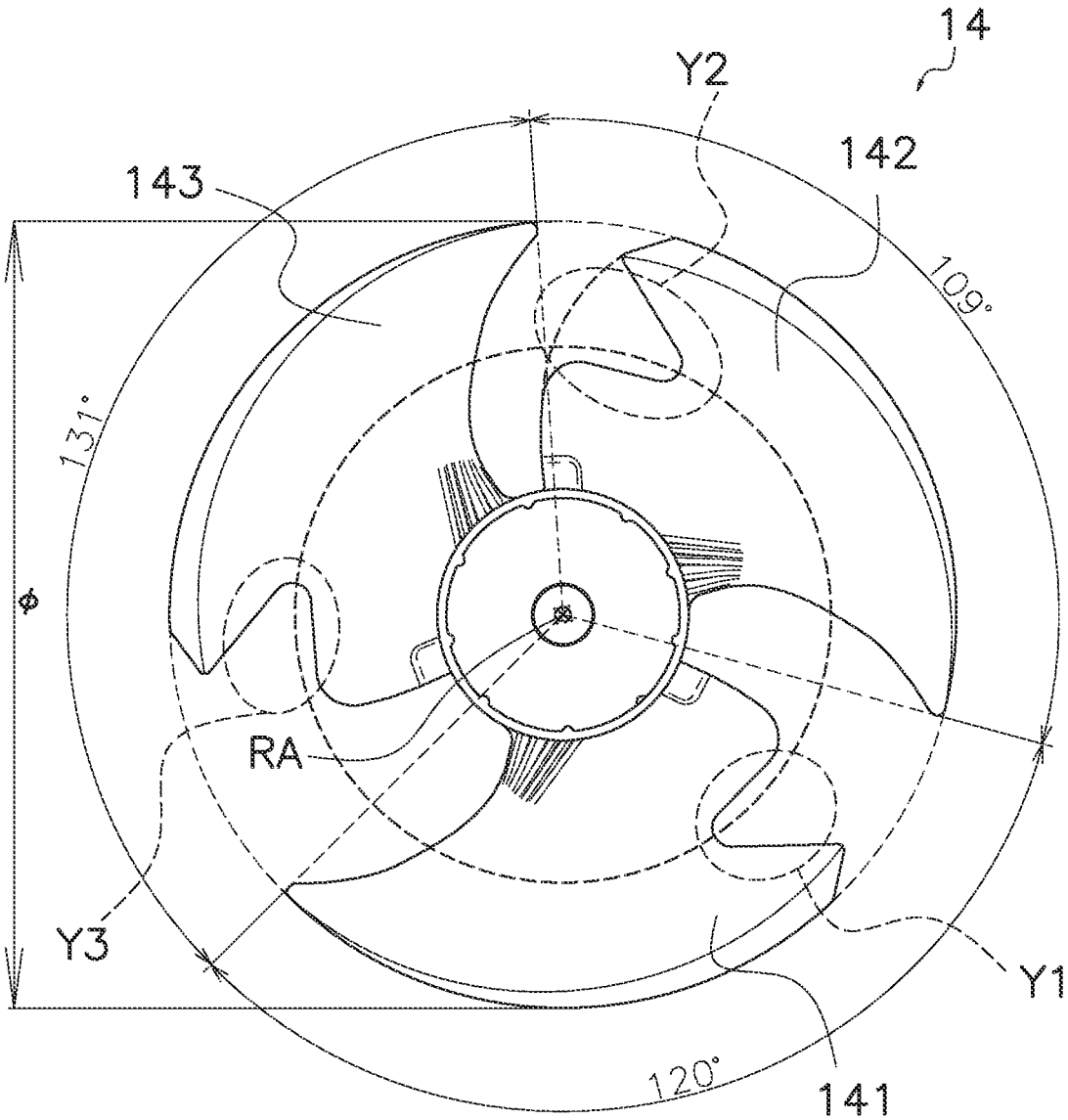
FIG. 3 is a front view of a propeller fan 14.

The propeller fan 14 rotates around a rotation axis RA. As shown in FIG. 3, the propeller fan 14 includes a blade 141, a blade 142, and a blade 143 disposed at unequal pitches. The angles the blade 141, the blade 142, and the blade 143 form with each other are not equal. For example, as shown in FIG. 3, the central angle occupied by the blade 141 is 120°, the central angle occupied by the blade 142 is 109°, and the central angle occupied by the blade 143 is 131°. Configuring the propeller fan 14 at unequal pitches suppresses noise at a specific frequency. Specifically, the specific frequency is a frequency corresponding to the number of revolutions of the fan multiplied by the number of blades (3 in the present embodiment), and a frequency that is an integral multiple thereof.

At the trailing edge of the blade 141, a concave portion Y1 dented toward the leading edge is formed. At the trailing edge of the blade 142, a concave portion Y2 dented toward the leading edge is formed. At the trailing edge of the blade 143, a concave portion Y3 dented toward the leading edge is formed. Providing the concave portions Y1 to Y3 increases the airflow volume transmitted by the propeller fan 14, and suppresses the noise generated by the propeller fan 14.

Returning to FIG. 2, the blade 141, the blade 142, and the blade 143 each have a length H0 in the rotation axis RA direction. The propeller fan 14 has a diameter φ.

(4-2) Propeller Fan Motor 14*a*

The propeller fan motor 14*a* generates power necessary for moving the propeller fan 14.

(4-3) Enclosure 51

As shown in FIG. 2, the enclosure 51 of the blower 50 also serves as the enclosure of the heat source unit 10. The enclosure 51 houses the propeller fan 14. The enclosure 51 has a depth L. The enclosure 51 includes a bell mouth 52.

Figure 4:
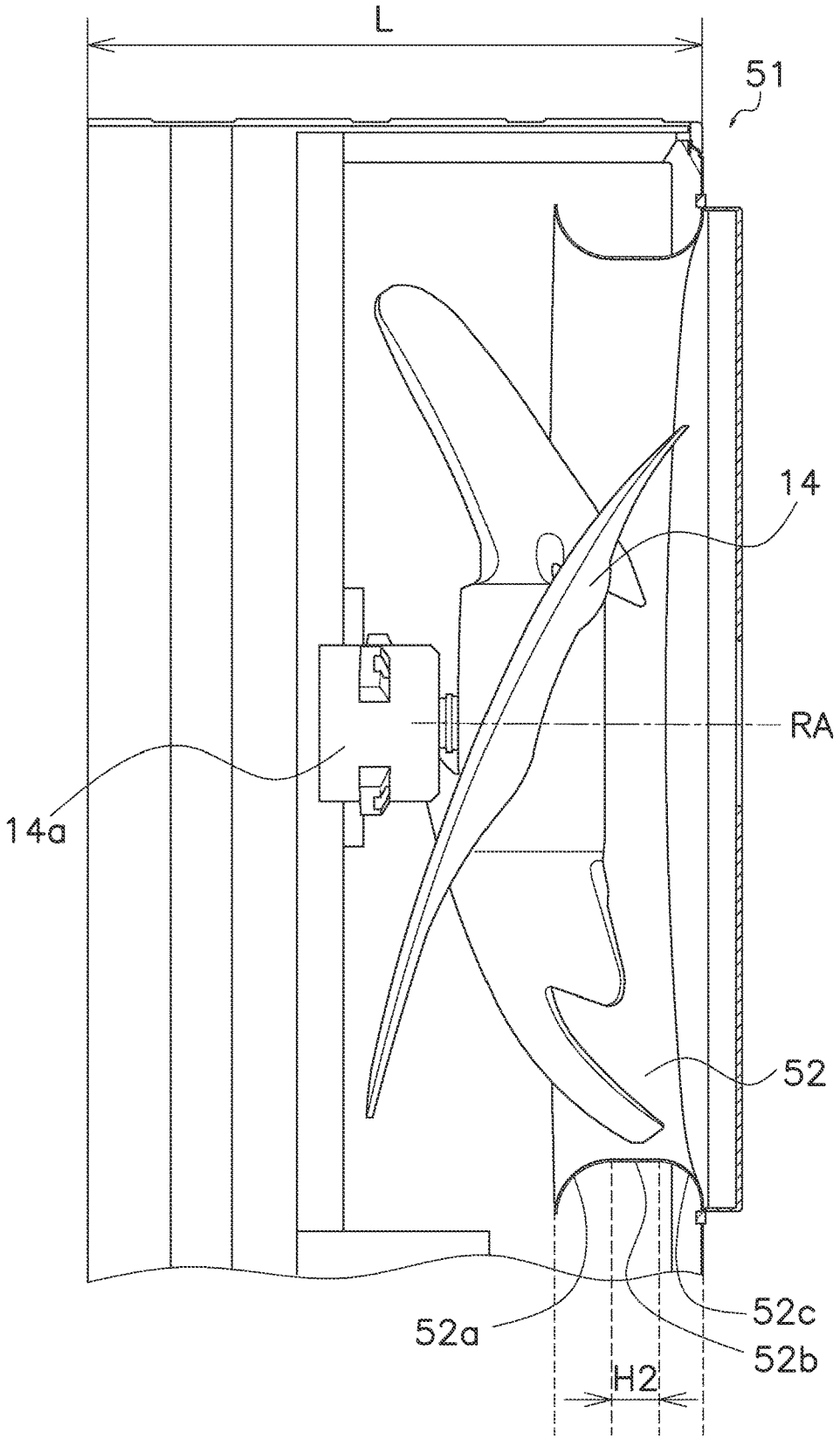
FIG. 4 is a side view of the interior of the heat source unit 10.
Figure 5:
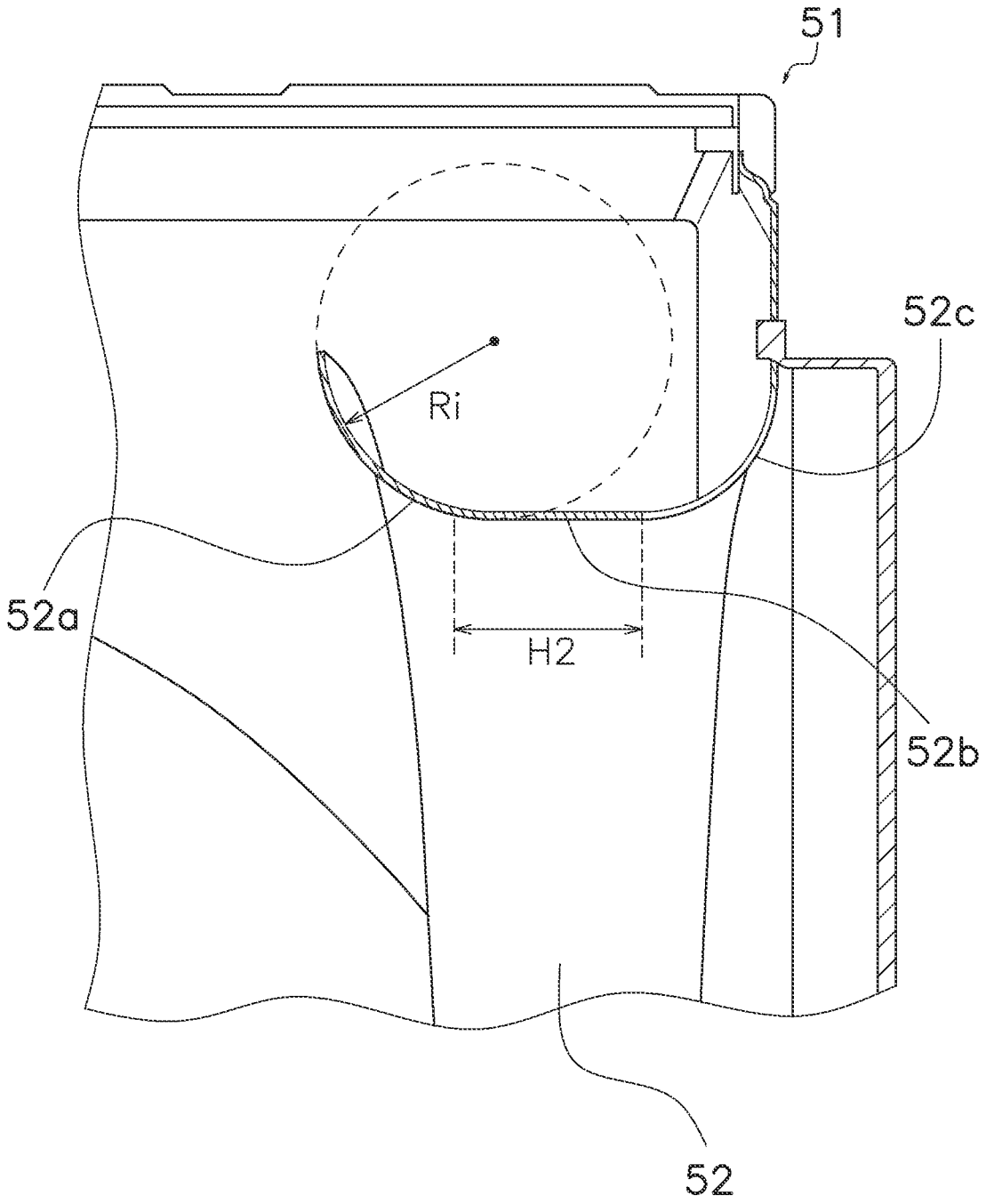
FIG. 5 is an enlarged view of FIG. 4.

As shown in FIG. 4, the bell mouth 52 includes an intake part 52*a*, a cylindrical part 52*b*, and a blow-out part 52*c*. The cylindrical part 52*b* has a cylindrical shape parallel to the rotation axis RA. The cylindrical part 52*b* has a length H2 in the rotation axis RA direction. The intake part 52*a* is located upstream of the cylindrical part 52*b* in the direction of the air flow generated by the propeller fan 14. As shown in FIG. 5, the intake part 52*a* has a curved part of the radius of curvature Ri in the periphery in side view. The blow-out part 52*c* is located downstream of the cylindrical part 52*b* in the direction of the air flow generated by the propeller fan 14.

Figure 6:
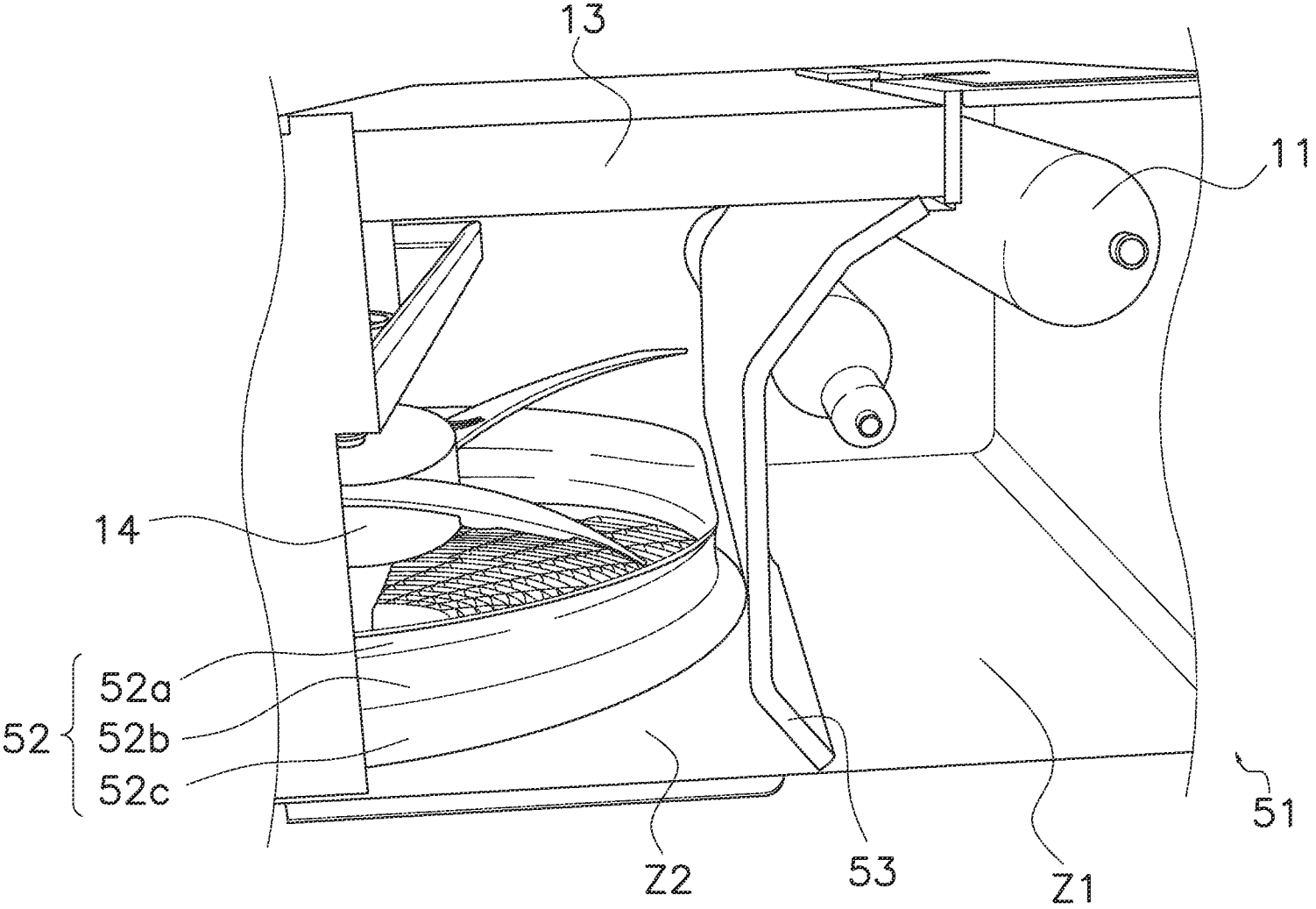
FIG. 6 is a perspective view of the interior of the heat source unit 10.

As shown in FIG. 6, the enclosure 51 includes a partition plate 53 that partitions a machine chamber Z1 in which the compressor 11 is installed and a heat exchange chamber Z2 in which the heat source heat exchanger 13 is installed. The intake part 52*a* is partially removed to prevent interference with the partition plate 53 or the heat source heat exchanger 13. Therefore, as shown in FIG. 2, the intake part 52*a* is less widespread than the cylindrical part 52*b* in plan view.

As shown in FIG. 2, the propeller fan 14 crosses the entire area of the cylindrical part 52*b* in plan view or side view. In other words, the propeller fan 14 overlaps with the intake part 52*a* and at least partially overlaps with the blow-out part 52*c*.

(5) Design of Blower 50

The inventor has investigated the transition of OA noise, 1 NZ noise, and 2 NZ noise while changing various dimensional ratios of the blower 50, and the like.

Here, the OA noise is a combination of sounds of wide frequency band components. The level of the OA noise corresponds to the overall noise level.

The 1 NZ noise is a sound of the component corresponding to the frequency obtained by multiplying the number of revolutions of the an (N) by the number of blades (Z).

Furthermore, the 2 NZ noise is a sound of the component corresponding to twice the frequency of the 1 NZ noise. The 1 NZ noise or the 2 NZ noise, if louder than a sound in the surrounding frequency band, will be heard as an abnormal sound.

(5-1) Ratio of Length H2 to length H0

Figure 7:
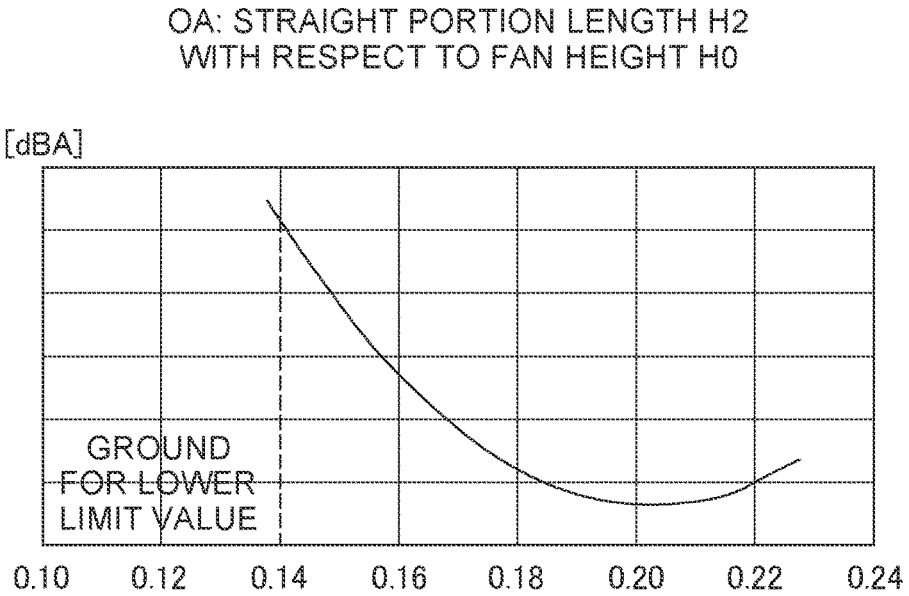
FIG. 7 is a graph showing transition of OA noise with respect to the ratio of length H2 to length H0.

The noise has been investigated while changing the ratio of the length H2 to the length H0. FIG. 7 shows the OA noise, FIG. 8 shows the 2 NZ noise, and FIG. 9 shows the 1 NZ noise.

As shown in FIG. 7, when the ratio is small, the OA noise increases. Therefore, to suppress the OA noise below a predetermined level, the lower limit of the ratio is derived as 0.14.

Figure 8:
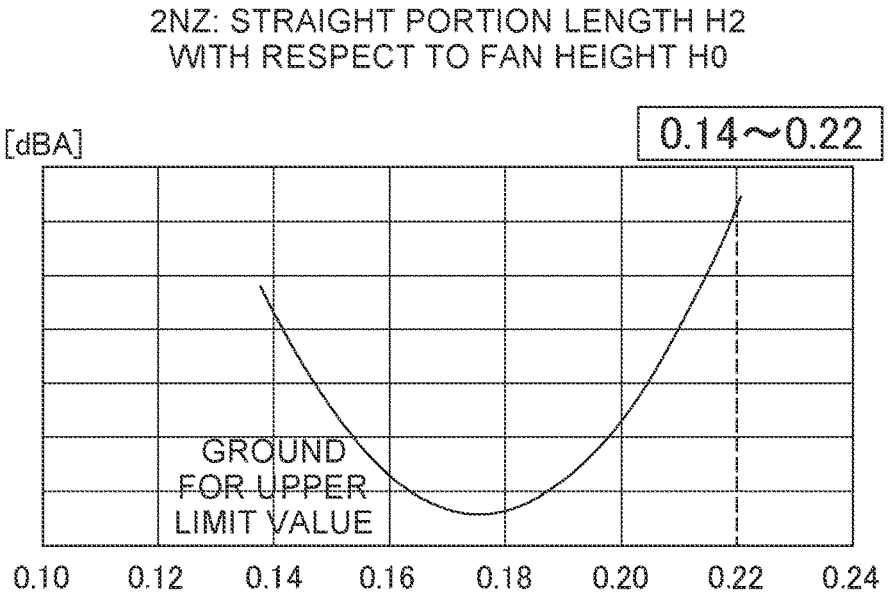
FIG. 8 is a graph showing transition of 2 NZ noise with respect to the ratio of length H2 to length H0.
Figure 9:
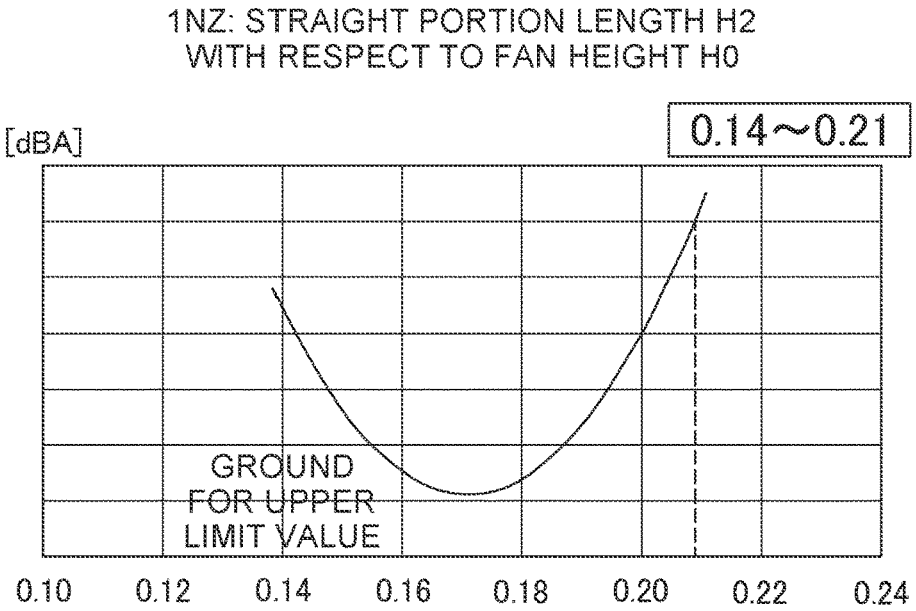
FIG. 9 is a graph showing transition of 1 NZ noise with respect to the ratio of length H2 to length H0.

As shown in FIG. 8, when the ratio is large, the 2 NZ noise increases. Therefore, to suppress the 2 NZ noise below a predetermined level, the upper limit of the ratio is derived as 0.22.

As described above, to suppress the OA noise and the 2 NZ noise, the ratio preferably satisfies the following relationship.

$$0.14 \leq \frac{H2}{H0} \leq 0.22\# \quad \text{Formula 1}$$

As shown in FIG. 9, when the ratio is large, the 1 NZ noise increases. Therefore, to suppress the 1 NZ noise below a predetermined level, the upper limit of the ratio is derived as 0.21.

As described above, to suppress all the OA noise, the 1 NZ noise, and the 2 NZ noise, the ratio preferably satisfies the following relationship.

$$0.14 \leq \frac{H2}{H0} \leq 0.21\# \quad \text{Formula 2}$$

(5-2) Ratio of Length H2 to Diameter φ

Figure 10:
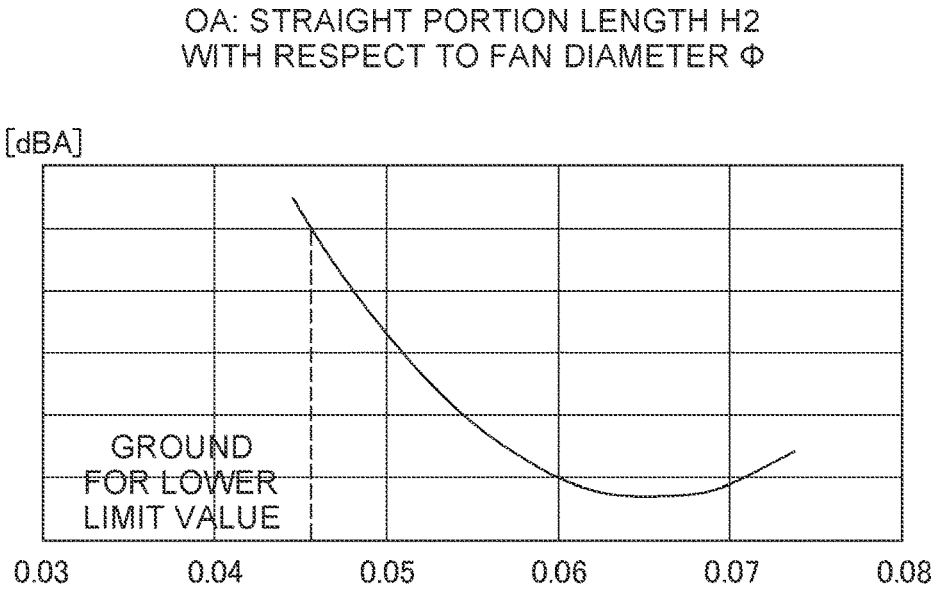
FIG. 10 is a graph showing transition of OA noise with respect to the ratio of length H2 to diameter φ.

The noise has been investigated while changing the ratio of the length H2 to the diameter φ. FIG. 10 shows the OA noise, FIG. 11 shows the 2 NZ noise, and FIG. 12 shows the 1 NZ noise.

As shown in FIG. 10, when the ratio is small, the OA noise increases. Therefore, to suppress the OA noise below a predetermined level, the lower limit of the ratio is derived as 0.045.

Figure 11:
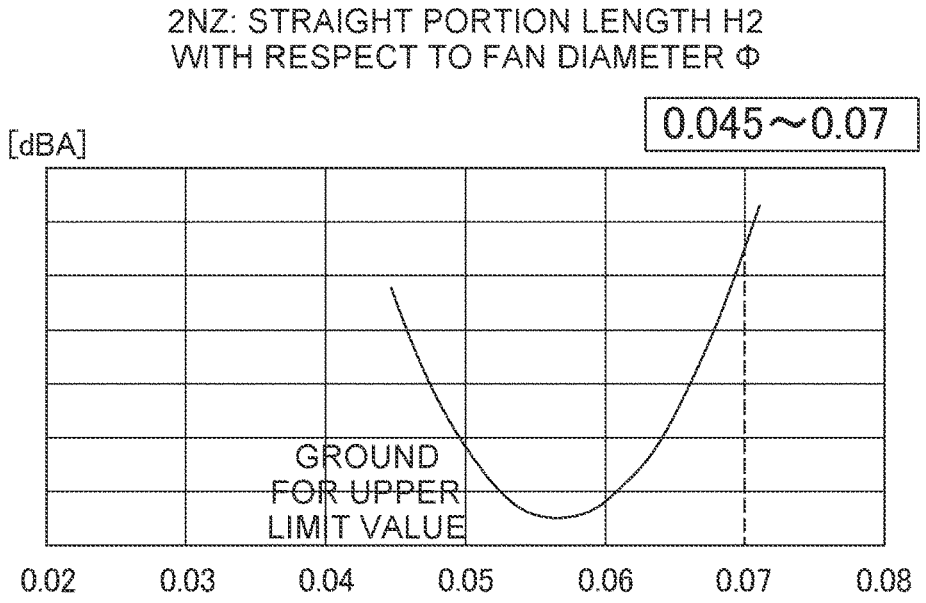
FIG. 11 is a graph showing transition of 2 NZ noise with respect to the ratio of length H2 to diameter φ.
Figure 12:
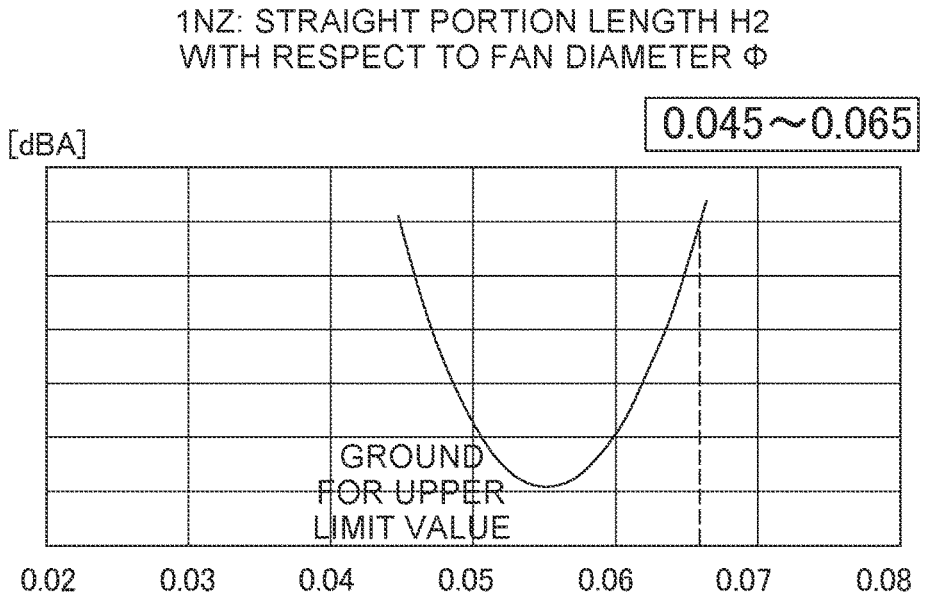
FIG. 12 is a graph showing transition of 1 NZ noise with respect to the ratio of length H2 to diameter φ.

As shown in FIG. 11, when the ratio is large, the 2 NZ noise increases. Therefore, to suppress the 2 NZ noise below a predetermined level, the upper limit of the ratio is derived as 0.070.

As described above, to suppress the OA noise and the 2 NZ noise, the ratio preferably satisfies the following relationship.

$$0.045 \leq \frac{H2}{\phi} \leq 0.070\# \quad \text{Formula 3}$$

As shown in FIG. 12, when the ratio is large, the 1 NZ noise increases. Therefore, to suppress the 1 NZ noise below a predetermined level, the upper limit of the ratio is derived as 0.065.

As described above, to suppress all the OA noise, the 1 NZ noise, and the 2 NZ noise, the ratio preferably satisfies the following relationship.

$$0.045 \leq \frac{H2}{\phi} \leq 0.065\# \quad \text{Formula 4}$$

(5-3) Ratio of length H2 to depth L

Figure 13:
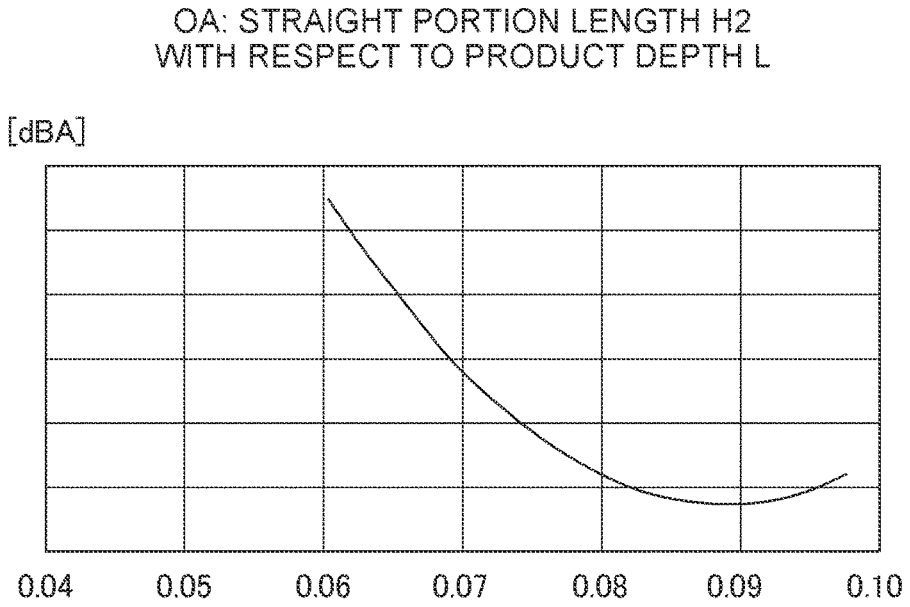
FIG. 13 is a graph showing transition of OA noise with respect to the ratio of length H2 to depth φ.

The noise has been investigated while changing the ratio of the length H2 to the depth L. FIG. 13 shows the OA noise, FIG. 14 shows the 2 NZ noise, and FIG. 15 shows the 1 NZ noise.

As shown in FIG. 13, when the ratio is small, the OA noise increases. Therefore, to suppress the OA noise below a predetermined level, the lower limit of the ratio is derived as 0.060.

Figure 14:
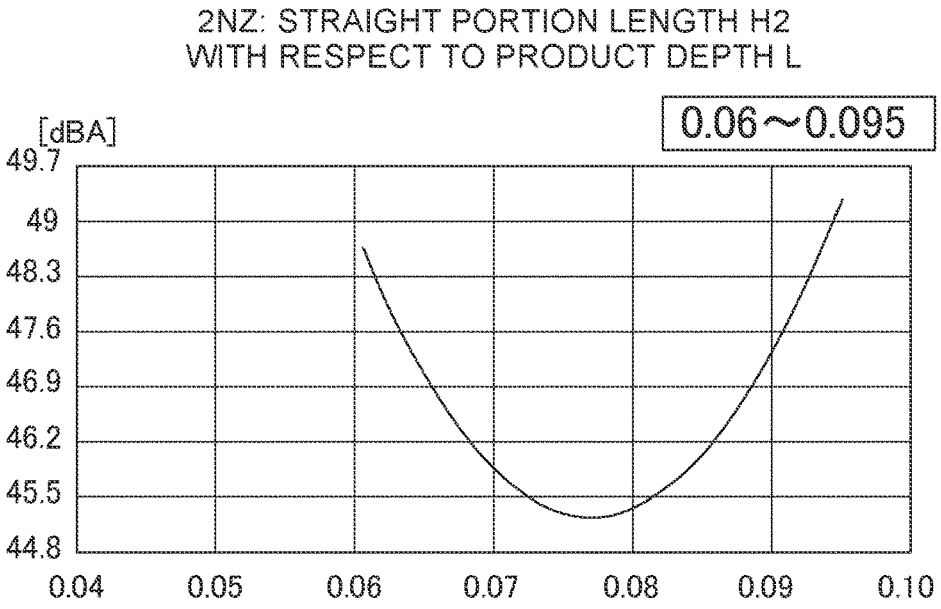
FIG. 14 is a graph showing transition of 2 NZ noise with respect to the ratio of length H2 to depth L.
Figure 15:
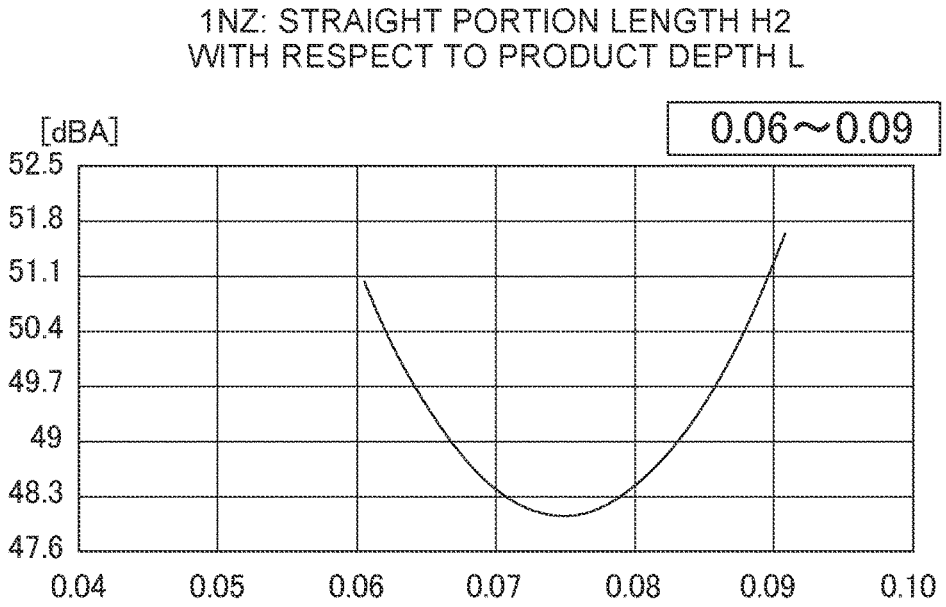
FIG. 15 is a graph showing transition of 1 NZ noise with respect to the ratio of length H2 to depth L.

As shown in FIG. 14, when the ratio is large, the 2 NZ noise increases. Therefore, to suppress the 2 NZ noise below a predetermined level, the upper limit of the ratio is derived as 0.095.

As described above, to suppress the OA noise and the 2 NZ noise, the ratio preferably satisfies the following relationship.

$$0.060 \leq \frac{H2}{L} \leq 0.095\# \quad \text{Formula 5}$$

As shown in FIG. 15, when the ratio is large, the 1 NZ noise increases. Therefore, to suppress the 1 NZ noise below a predetermined level, the upper limit of the ratio is derived as 0.090.

As described above, to suppress all the OA noise, the 1 NZ noise, and the 2 NZ noise, the ratio preferably satisfies the following relationship.

$$0.060 \leq \frac{H2}{L} \leq 0.090\# \quad \text{Formula 6}$$

(5-4) Ratio of Radius of Curvature Ri to Depth L

Figure 16:
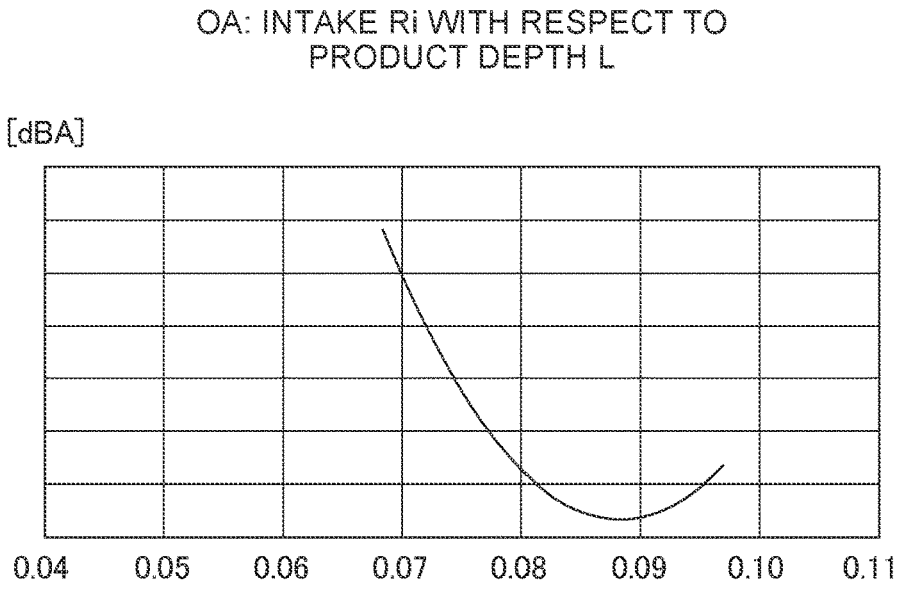
FIG. 16 is a graph showing transition of OA noise with respect to the ratio of radius of curvature Ri to depth L.

The noise has been investigated while changing the ratio of the radius of curvature Ri to the depth L. FIG. 16 shows the OA noise, FIG. 17 shows the 2 NZ noise, and FIG. 18 shows the 1 NZ noise.

As shown in FIG. 16, when the ratio is small, the OA noise increases. Therefore, to suppress the OA noise below a predetermined level, the lower limit of the ratio is derived as 0.070.

Figure 17:
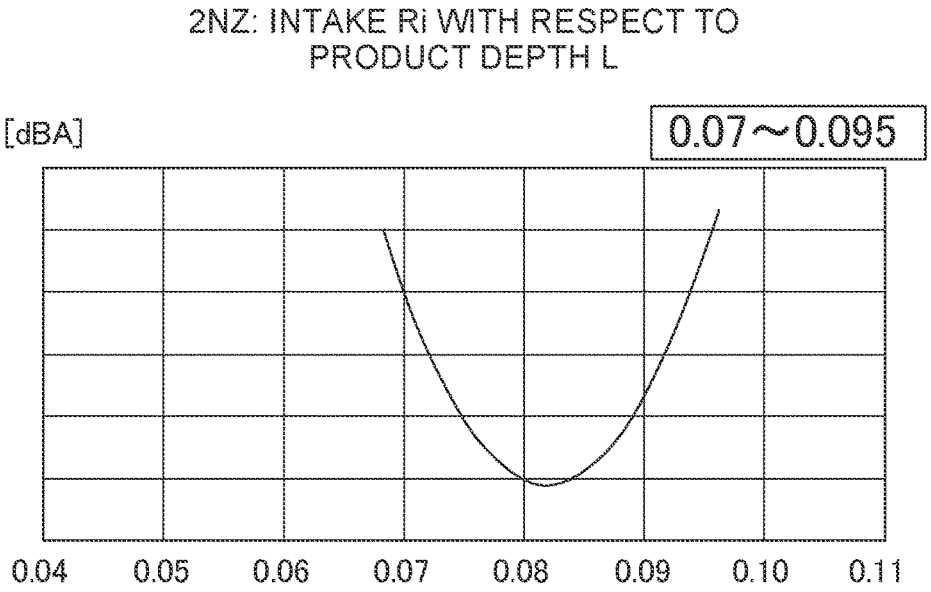
FIG. 17 is a graph showing transition of 2 NZ noise with respect to the ratio of radius of curvature Ri to depth L.
Figure 18:
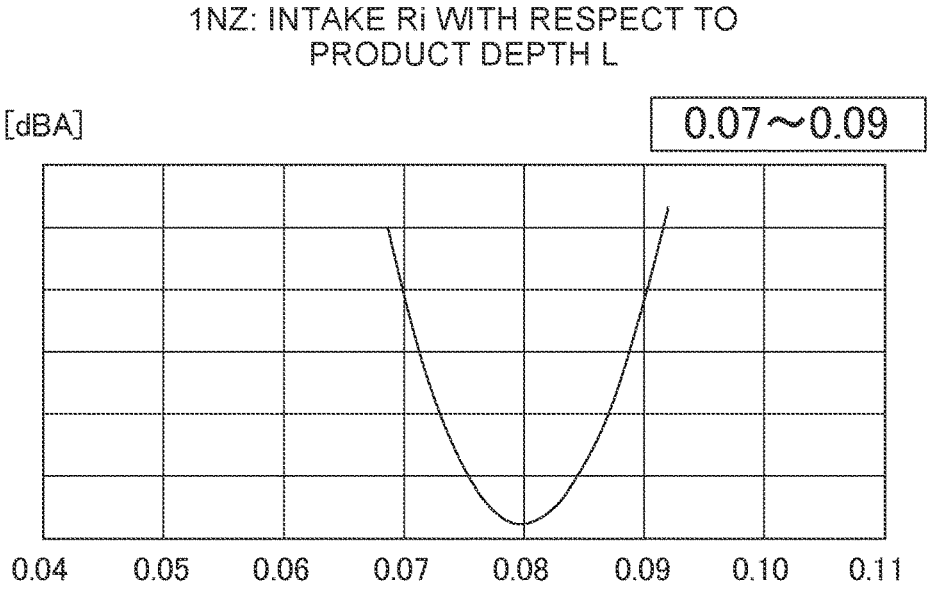
FIG. 18 is a graph showing transition of 1 NZ noise with respect to the ratio of radius of curvature Ri to depth L.

As shown in FIG. 17, when the ratio is large, the 2 NZ noise increases. Therefore, to suppress the 2 NZ noise below a predetermined level, the upper limit of the ratio is derived as 0.095.

As described above, to suppress the OA noise and the 2 NZ noise, the ratio preferably satisfies the following relationship.

$$0.070 \leq \frac{Ri}{L} \leq 0.095\# \quad \text{Formula 7}$$

As shown in FIG. 18, when the ratio is large, the 1 NZ noise increases. Therefore, to suppress the 1 NZ noise below a predetermined level, the upper limit of the ratio is derived as 0.090.

As described above, to suppress all the OA noise, the 1 NZ noise, and the 2 NZ noise, the ratio preferably satisfies the following relationship.

$$0.070 \leq \frac{Ri}{L} \leq 0.090\# \quad \text{Formula 8}$$

(5-5) Ratio of Radius of Curvature Ri to length H0

Figure 19:
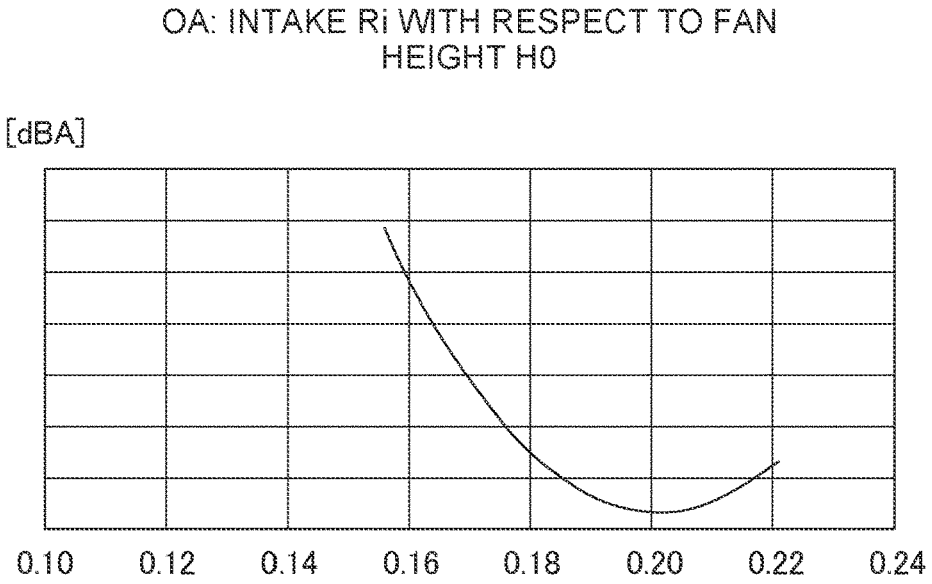
FIG. 19 is a graph showing transition of OA noise with respect to the ratio of radius of curvature Ri to length H0.

The noise has been investigated while changing the ratio of the radius of curvature Ri to the length H0. FIG. 19 shows the OA noise, FIG. 20 shows the 2 NZ noise, and FIG. 21 shows the 1 NZ noise.

As shown in FIG. 19, when the ratio is small, the OA noise increases. Therefore, to suppress the OA noise below a predetermined level, the lower limit of the ratio is derived as 0.16.

Figure 20:
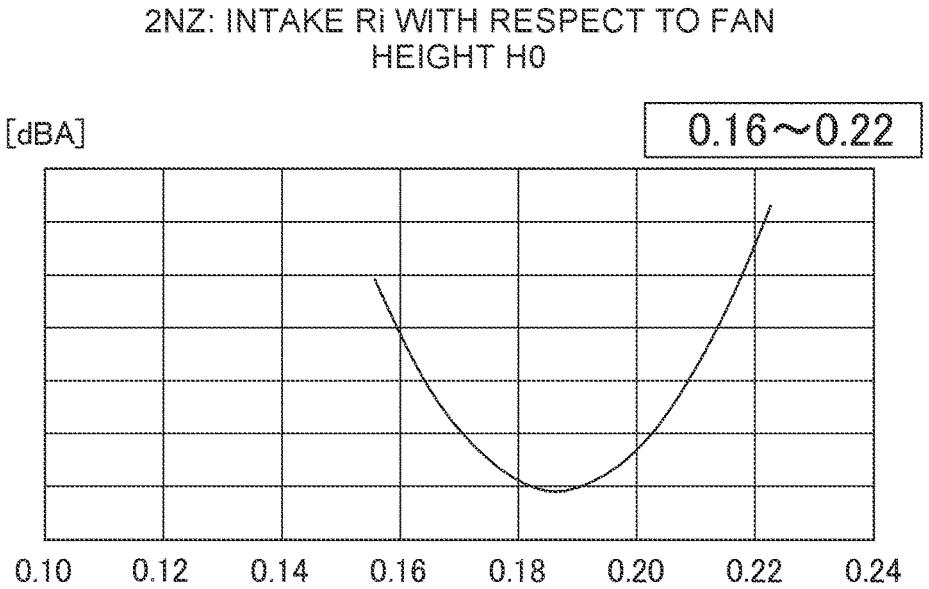
FIG. 20 is a graph showing transition of 2 NZ noise with respect to the ratio of radius of curvature Ri to length H0.
Figure 21:
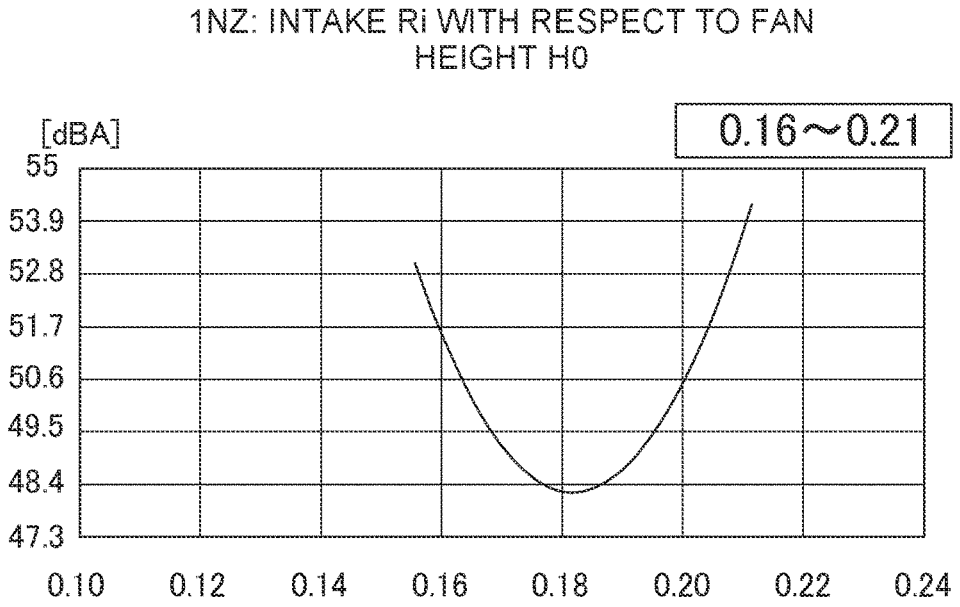
FIG. 21 is a graph showing transition of 1 NZ noise with respect to the ratio of radius of curvature Ri to length H0.

As shown in FIG. 20, when the ratio is large, the 2 NZ noise increases. Therefore, to suppress the 2 NZ noise below a predetermined level, the upper limit of the ratio is derived as 0.22.

As described above, to suppress the OA noise and the 2 NZ noise, the ratio preferably satisfies the following relationship.

$$0.16 \leq \frac{Ri}{H0} \leq 0.22\# \quad \text{Formula 9}$$

As shown in FIG. 21, when the ratio is large, the 1 NZ noise increases. Therefore, to suppress the 1 NZ noise below a predetermined level, the upper limit of the ratio is derived as 0.21.

As described above, to suppress all the OA noise, the 1 NZ noise, and the 2 NZ noise, the ratio preferably satisfies the following relationship.

$$0.16 \leq \frac{Ri}{H0} \leq 0.21\# \quad \text{Formula 10}$$

(5-6) Ratio of Radius of Curvature Ri to Diameter φ

Figure 22:
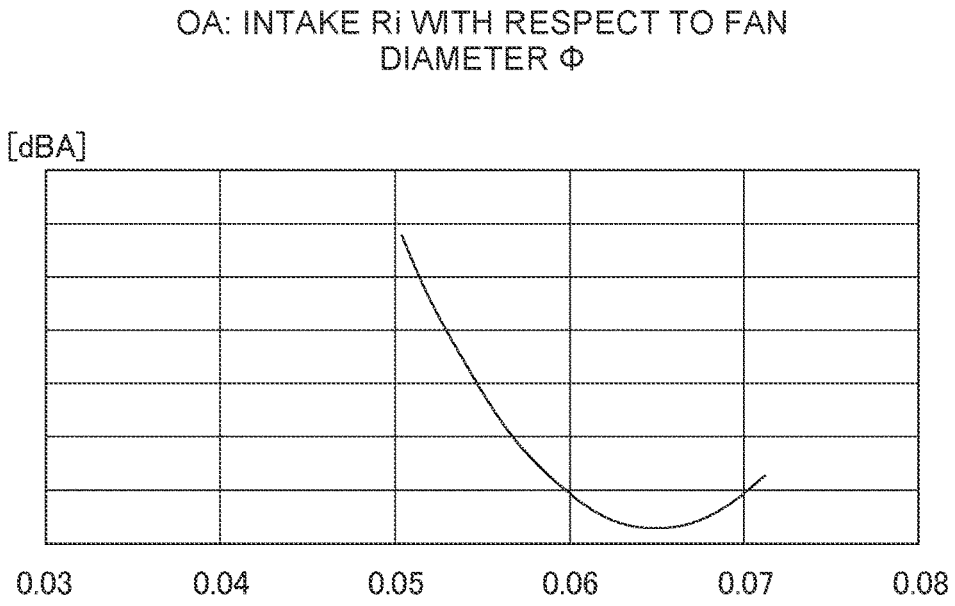
FIG. 22 is a graph showing transition of OA noise with respect to the ratio of radius of curvature Ri to diameter φ.

The noise has been investigated while changing the ratio of the radius of curvature Ri to the diameter φ. FIG. 22 shows the OA noise, FIG. 23 shows the 2 NZ noise, and FIG. 24 shows the 1 NZ noise.

As shown in FIG. 22, when the ratio is small, the OA noise increases. Therefore, to suppress the OA noise below a predetermined level, the lower limit of the ratio is derived as 0.050.

Figure 23:
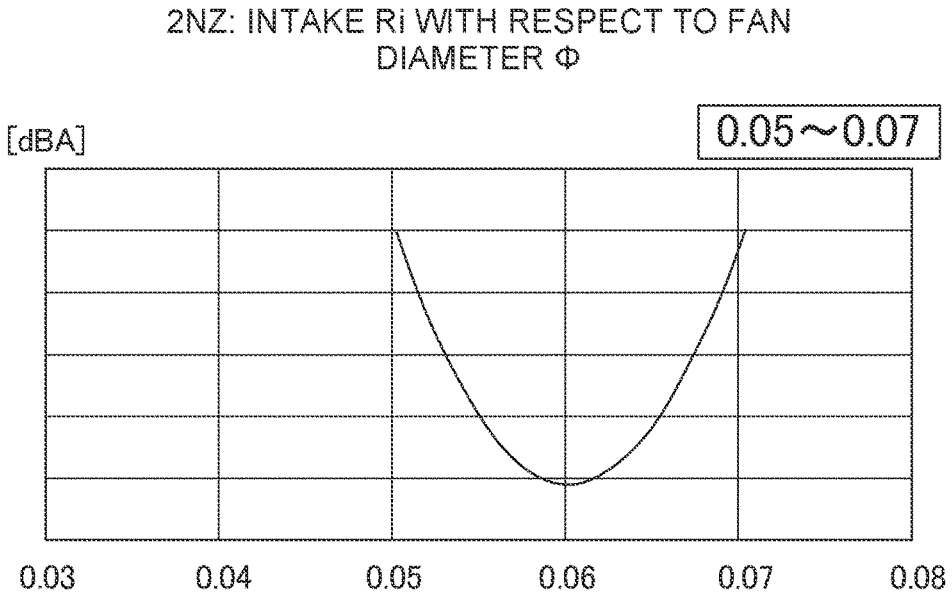
FIG. 23 is a graph showing transition of 2 NZ noise with respect to the ratio of radius of curvature Ri to diameter φ.
Figure 24:
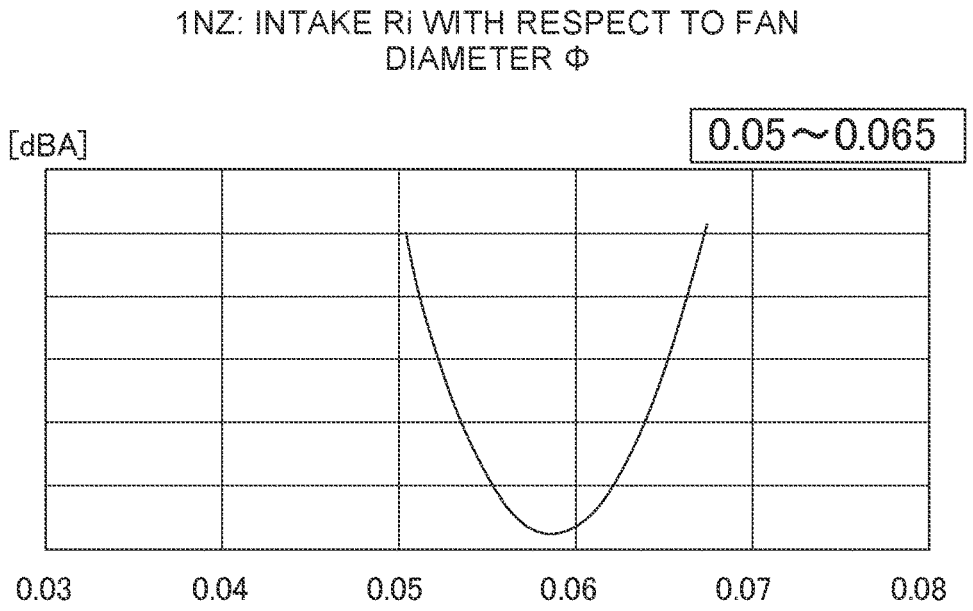
FIG. 24 is a graph showing transition of 1 NZ noise with respect to the ratio of radius of curvature Ri to diameter φ.

As shown in FIG. 23, when the ratio is large, the 2 NZ noise increases. Therefore, to suppress the 2 NZ noise below a predetermined level, the upper limit of the ratio is derived as 0.070.

As described above, to suppress the OA noise and the 2 NZ noise, the ratio preferably satisfies the following relationship.

$$0.050 \leq \frac{Ri}{\phi} \leq 0.070\# \quad \text{Formula 11}$$

As shown in FIG. 24, when the ratio is large, the 1 NZ noise increases. Therefore, to suppress the 1 NZ noise below a predetermined level, the upper limit of the ratio is derived as 0.065.

As described above, to suppress all the OA noise, the 1 NZ noise, and the 2 NZ noise, the ratio preferably satisfies the following relationship.

$$0.050 \leq \frac{Ri}{\phi} \leq 0.065\# \quad \text{Formula 12}$$

(6) Features

The above-described configuration can suppress the OA noise and the 2 NZ noise, or can suppress all the OA noise, the 1 NZ noise, and the 2 NZ noise. Therefore, noise is suppressed in the blower 50, the heat source unit 10, or the heat pump device 100.

(7) Modifications (7-1) Modification A

The above-described heat pump device 100 is configured as an air conditioner. Instead, the heat pump device 100 may be a refrigeration apparatus other than the air conditioner. For example, the heat pump device 100 may he a refrigerator, a freezer, a water heater, or the like.

(7-2) Modification B

In the above-described configuration, the propeller fan 14 includes the concave portions Y1 to Y3. Instead, the propeller fan 14 does not have to include the concave portions Y1 to Y3.

(7-3) Modification C

In the above-described configuration, the intake part 52*a* of the bell mouth 52 is partially removed. Instead, the intake part 52*a* of the bell mouth 52 may exist in the whole circumference.

(7-4) Modification D

In the above-described configuration, the bell mouth 52 includes the intake part 52*a* and the blow-out part 52*c*. Instead, the bell mouth 52 may include only one of the intake part 52*a* and the blow-out part 52*c*. Furthermore, the bell mouth 52 needs to include none of the intake part 52*a* and the blow-out part 52*c*.

Conclusion

The embodiment of the present disclosure has been described above, but it will be understood that various changes to forms and details can be made without departing from the gist and scope of the present disclosure as set forth in the claims.

The invention claimed is:

1. A blower comprising:

a propeller fan configured to rotate around a rotation axis, the propeller fan including a plurality of blades at unequal pitches; and an enclosure housing the propeller fan, the enclosure including a bell mouth, and the enclosure having a depth L, the bell mouth including a cylindrical part parallel to the rotation axis, and the relationships $$0.14 \leq \frac{H2}{H0} \leq 0.22$$

and $$0.060 \leq \frac{H2}{L} \leq 0.095$$

are satisfied,

H0 being a length of the blades in a rotation axis direction and H2 being a length of the cylindrical part being in the rotation axis direction.

2. The blower according to claim 1, wherein $$0.14 \leq \frac{H2}{H0} \leq 0.21..$$

3. The blower according to claim 1, wherein $$0.060 \leq \frac{H2}{L} \leq 0.090.$$

4. The blower according to claim 1, wherein the bell mouth further includes an intake part with a radius of curvature Ri, and $$0.070 \leq \frac{Ri}{L} \leq 0.095.$$

5. The blower according to claim 4, wherein $$0.070 \leq \frac{Ri}{L} \leq 0.090.$$

6. The blower according to claim 1, wherein the bell mouth further includes an intake part with a radius of curvature Ri, and $$0.16 \leq \frac{Ri}{H0} \leq 0.22.$$

7. The blower according to claim 6, wherein $$0.16 \leq \frac{Ri}{H0} \leq 0.21.$$

8. The blower according to claim 1, wherein the bell mouth further includes an intake part with a radius of curvature Ri, and $$0.050 \leq \frac{Ri}{\phi} \leq 0.070,$$

φ being a diameter of the propeller fan.

9. The blower according to claim 8, wherein the relationship $$0.050 \leq \frac{Ri}{\phi} \leq 0.065$$

is satisfied.

10. A heat pump unit including the blower according to claim 1, the heat pump further comprising:

a heat exchanger configured to exchange heat between air in an air flow formed by the blower and a refrigerant.

11. The blower according to claim 1, wherein the relationship $$0.045 \leq \frac{H2}{\phi} \leq 0.070$$

satisfied,

φ being a diameter of the propeller fan.

12. The blower according to claim 11, wherein the relationship $$0.045 \leq \frac{H2}{\phi} \leq 0.065$$

is satisfied.

* * * * *